United States Patent [19]

Kirsch

[11] 4,169,612

[45] Oct. 2, 1979

[54] SKI BINDINGS

[76] Inventor: Bernhard Kirsch, Im Litzelholz 23, 5500 Trier-Biewer, Fed. Rep. of Germany

[21] Appl. No.: 839,460

[22] Filed: Oct. 4, 1977

[30] Foreign Application Priority Data

Oct. 7, 1976 [DE] Fed. Rep. of Germany ..... 2645253
Feb. 14, 1977 [DE] Fed. Rep. of Germany ..... 2706133
Apr. 14, 1977 [DE] Fed. Rep. of Germany ..... 2716431

[51] Int. Cl.[2] ..... A63C 9/08
[52] U.S. Cl. ..... 280/611; 280/635
[58] Field of Search ..... 280/620, 623, 618, 613, 280/611, 627, 626, 634, 635

[56] References Cited

U.S. PATENT DOCUMENTS 3,897,077 7/1975 Schweiger ..... 280/618
3,951,424 4/1976 Näpflin ..... 280/618
4,065,151 12/1977 Weinstein et al. ..... 280/618

*Primary Examiner*—Robert R. Song
*Attorney, Agent, or Firm*—Robert W. Beach; Ward Brown

[57] ABSTRACT

This invention relates to ski bindings of the kind which comprise a heel binding for fixing a ski boot heel to a ski, and a front binding having pivotally mounted toe clamps which are capable of releasing themselves from the ski boot toe when the pressure exerted by the boot on such toe clamps exceeds a certain amount. According to this invention the toe clamps are movable toward the point of the ski and free themselves from the ski to release the ski boot only in response to a forward pressure in the longitudinal direction of the ski.

The invention also consists in such a binding when associated in combination with a ski.

34 Claims, 53 Drawing Figures

Fig.6
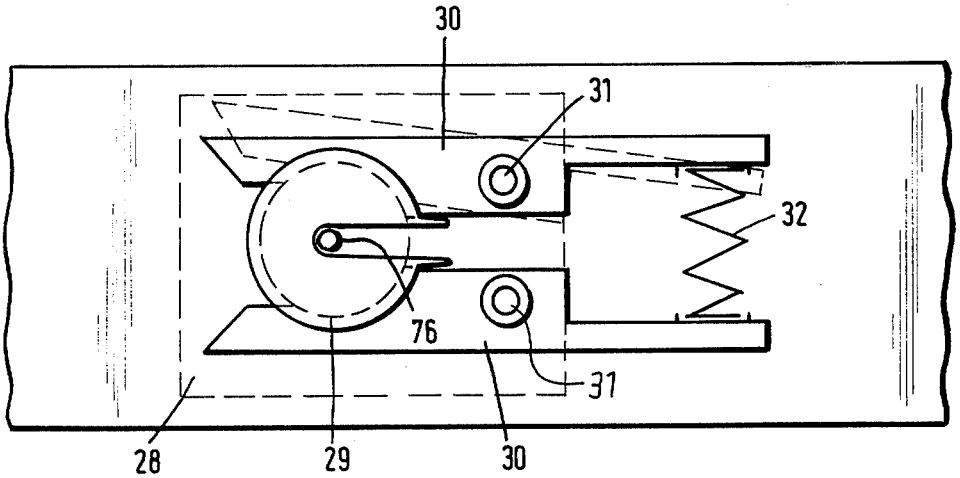
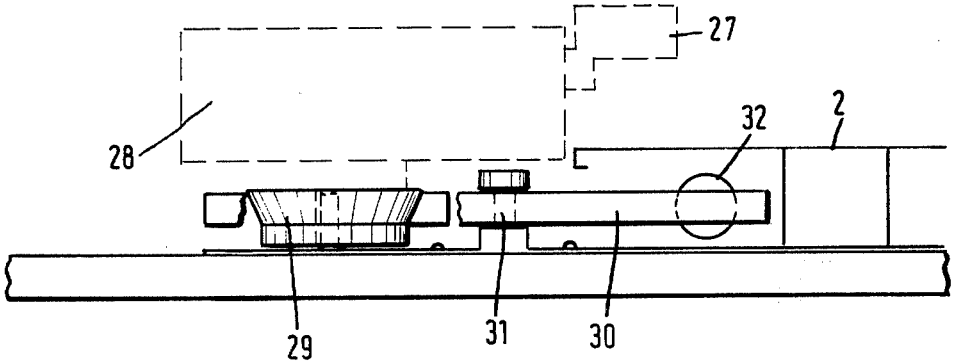
Fig.7

Fig.8
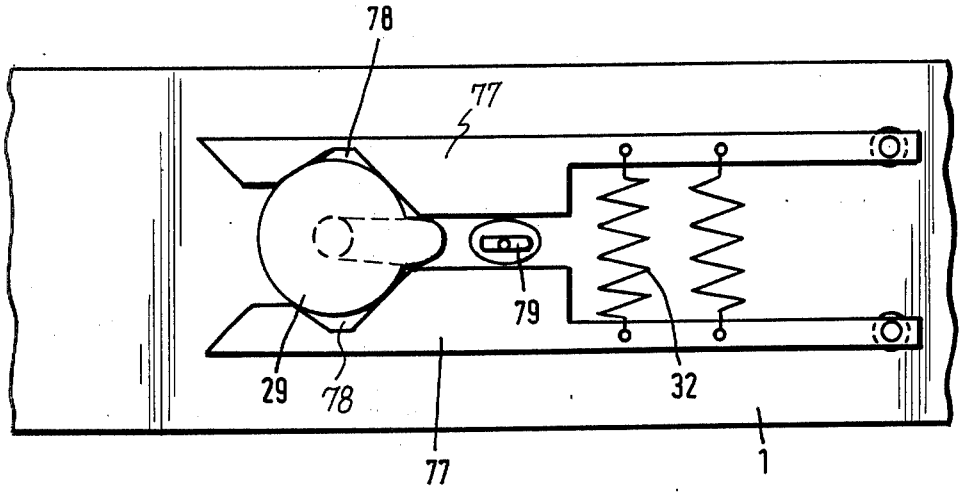
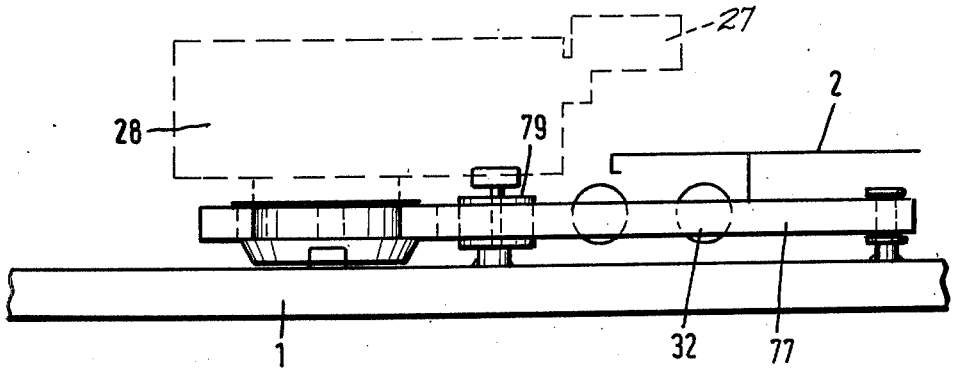
Fig.9

Fig.20
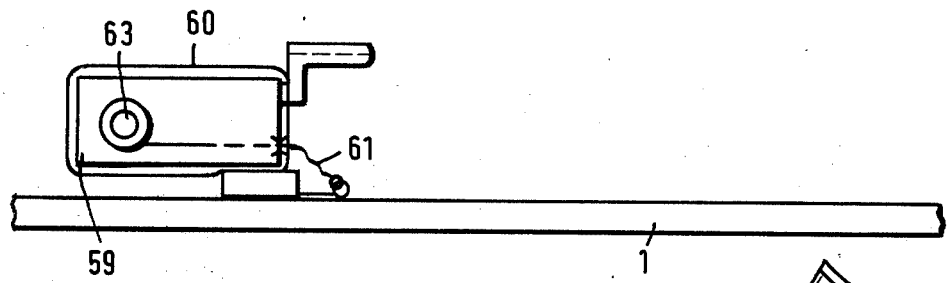
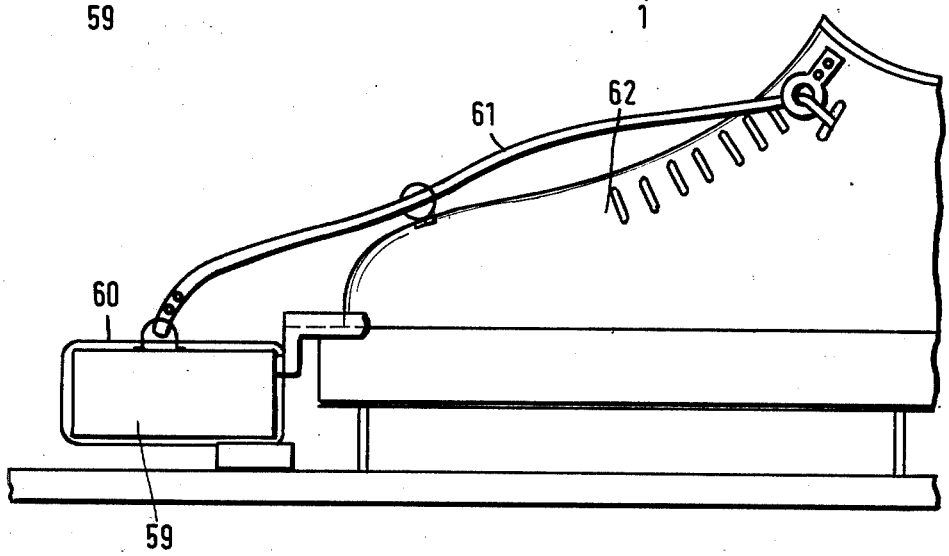
Fig.19

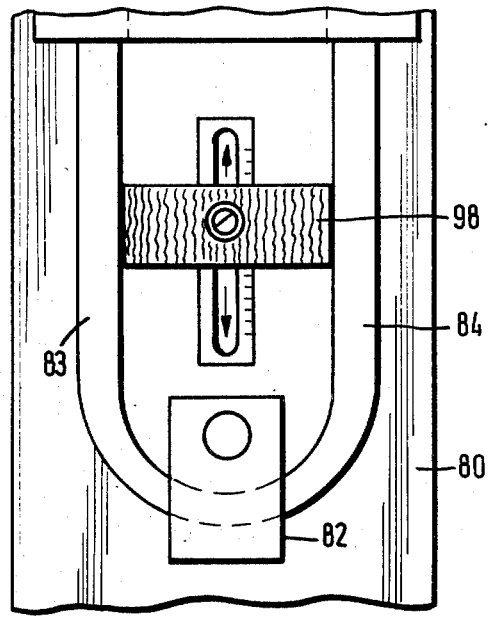
Fig.33
Fig.34
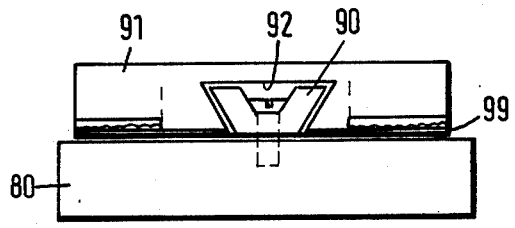
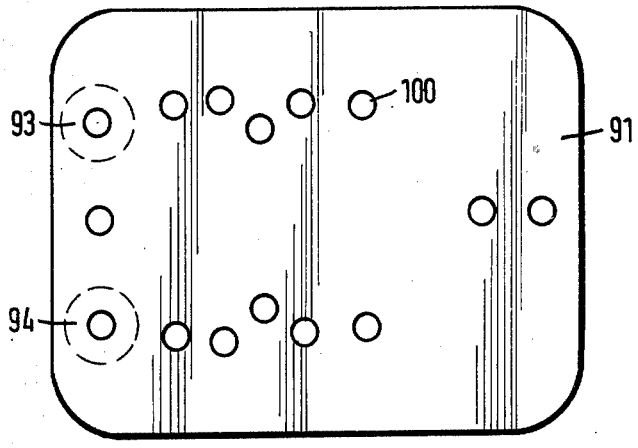
Fig.35

Fig.39
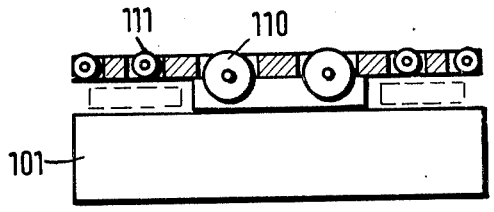
Fig.41
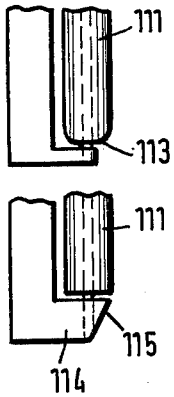
Fig.40
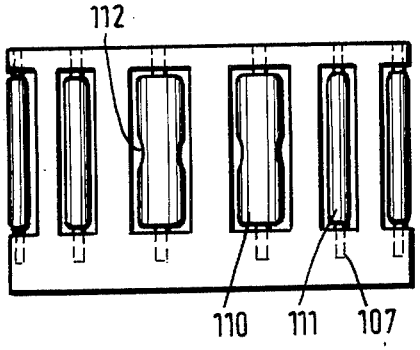
Fig.42
Fig.43
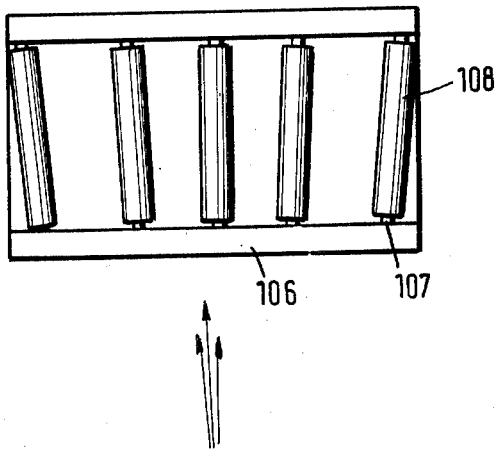

Fig.44
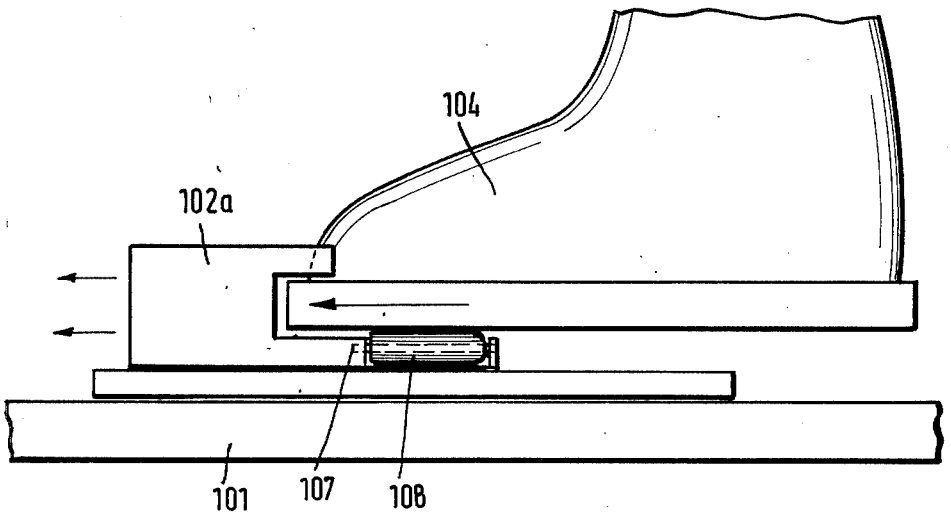
Fig.45
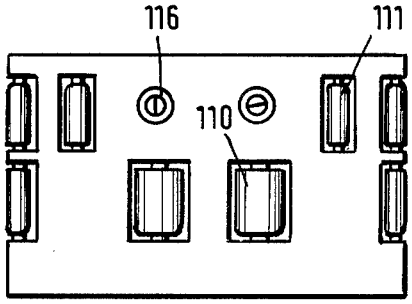
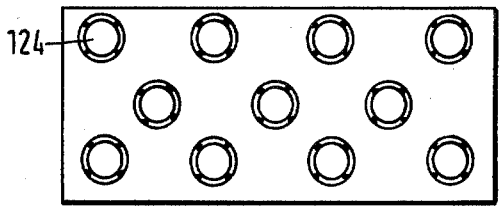
Fig.52
Fig.53
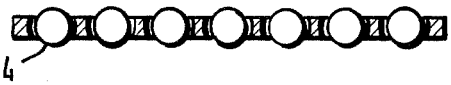

SKI BINDINGS

BACKGROUND OF THE INVENTION

The present invention relates to a ski binding comprising a heel binding fixed to a ski and a front binding including toe clamps releaseable from the ski boot and the ski when the pressure exerted by the ski boot on the toe clamps exceeds a certain level.

In a known ski binding, the toe clamps of the front binding prevent the ski boot from moving both forward toward the point of the ski and transversely of the longitudinal direction of the ski, the intention being that the toe clamps should release the ski boot when the pressure in either of the two directions exceeds a given level.

However, since the forces which the human foot is able to sustain without harm in these two directions are different, the toe clamps of the front binding in question ought to release at different forces depending on the direction of the force.

However, in the case of the ski binding in question this is only partially achieved since the toe clamps are held simply by one tensioning device, with the result that the force exerted on the toe clamps by the tensioning device is always the same.

It is therefore an object of the invention to provide a ski binding of the kind hereinbefore referred to which releases the ski boot when a certain pressure is exceeded under head-on impact and which also frees it in a known fashion when a different pressure is exceeded in a direction transversely of longitudinal direction of the ski.

SUMMARY OF THE INVENTION

This and other objects are achieved by virtue of the fact that the toe clamps, which are mounted to pivot, are enabled to move forward toward the point of the ski and to free themselves from the ski, thus releasing the ski boot, only in response to a pressure in the longitudinal direction of the ski.

In carrying the invention into effect, a spring-loaded plunger may be arranged on the underside of a plate carrying the toe clamps to engage in a recess underneath the plane of the ski boot. A mounting carrying the toe clamps may have at its rear end a cut out which fits around a locating stem secured to the ski, and lateral recesses may be provided into which the ends of a spring-clip engage.

Moreover, there may be mounted on the underside of a mounting carrying the toe clamps a rebated projection which is held by spring-loaded jaws which act like pincers. A rotable spacer device is then advantageously arranged between the spring-loaded jaws.

In another embodiment, an adjustable downwardly projecting protruberance engages in a recess in a leaf spring which is arranged on a mounting carrying the toe clamps.

Each toe clamp may be arranged on a carrier which is outwardly pivotable and the two carriers may be connected together by a spring and contain cut outs directed transversely to the longitudinal direction of the ski, which cut-outs are open at the inner ends and fit around pegs which project upward from the plane of the ski.

Alternatively, each toe clamp may be arranged on a carrier which is outwardly pivotable and the two carriers may be connected together by a spring and each have on the underside a peg, the pegs engaging in arcuate slots in a plate connected to the ski, the slots being open at their outer ends.

The releasable front binding may be connected to the associated ski boot or ski by means of a retainer or safety strap and the releasable front binding may have a winding up device for the strap.

In another embodiment, the front binding is connected to the arms of a ski brake in such a way that when the ski binding is secured, the front binding holds the arms of the brake in the nonbraking position and when the front binding is released the arms are freed, and the front binding has lateral projections which hold the front ends of the brake-arms in the non-braking position.

Two fittings may be secured to the underside of a plate which forms part of the releasable front binding and which carries the toe clamps, said two fittings being arranged next to one another at a distance and then outer sides may be held by the resilient arms of a spring clip secured to the ski when the front binding is in the closed position, while between the fittings is arranged a recess extending in the longitudinal direction of the ski which is open at the rear and into which a retainer device fixed to the ski projects.

These fittings could be in the form of rollers and the resilient arms of the clip contain indentations to receive the rollers, and a clamp which is displacable in the longitudinal direction of the ski can fit over the resilient arms of the clip.

Furthermore a preset resilient device which is displaceable in the longitudinal direction of the ski may be arranged between the resilient arms of the clip, the plate carrying the toe clamps may contain spaced mounting holes, and the recess in the under side of the plate may be cut to a dovetail shape.

In another embodiment, a roller whose axis of rotation extends in the longitudinal direction of the ski is carried by the ski for engagement with the sole of the ski boot.

This roller is advantageously divided into a plurality of sections mounted one behind the other on a common shaft and a plurality of rollers may advantageously be arranged at intervals next to one another and the rollers arranged next to one another are advantageously of different diameters.

The shafts of the rollers arranged next to one another are preferably positioned on radii of a segment of a circle and the rollers are preferably staggered relative to one another and have one or more constrictions in their circumferential faces, while the rear edges of the rollers are preferably bevelled and the part of the mounting adjacent the rear end-face of the rollers preferably has a bevel.

The roller may be arranged on a part of the binding which is detachable from the ski. The roller is advantageously mounted at the front end of a resilient tie so as to be able to swing relative to the ski. It is advantageous for a plurality of rollers to be connected together to form a pivoting unit and for a retainer strap to fit over the pivot ties of the rollers.

The roller may either be cylindrical or in the form of a universally rotatable ball.

BRIEF DESCRIPTION OF THE DRAWINGS

In order that the invention may be more clearly understood, reference will now be made to the accompanying drawings which show certain embodiments thereof by way of example and in which:

FIG. 6 is a plan view of a further embodiment of front binding, FIG. 7 is a side view of the front binding of FIG. 6, FIG. 8 is a plan view of another embodiment of front binding, FIG. 9 is a side view of the front binding of FIG. 8, FIG. 19 is a side view of a ski binding according to the invention which has a detachable front binding connected to the ski boot by retainer straps.

FIG. 20 shows a front binding as in FIG. 19 having retainer straps which can be rolled up, FIG. 33 is a plan view of another embodiment of retainer clip, FIG. 34 is a cross section of the device of FIG. 27, FIG. 35 is a plan view of the plate carrying the toe clamps, FIG. 39 is a front view of an embodiment having rollers of different diameters, FIG. 40 is a plan view of the embodiment of FIG. 39, FIG. 41 is a side view of a roller having a bevelled front edge, FIG. 42 is a side view of a roller having a bevelled mounting, FIG. 43 is a plan view of radially arranged rollers, FIG. 44 shows a ski binding in which the rollers are connected to a front part which is detachable from the ski binding, FIG. 45 shows an arrangement in which the rollers are relatively staggered.

DETAILED DESCRIPTION OF PREFERRED EMBODIMENTS

Figure 1:
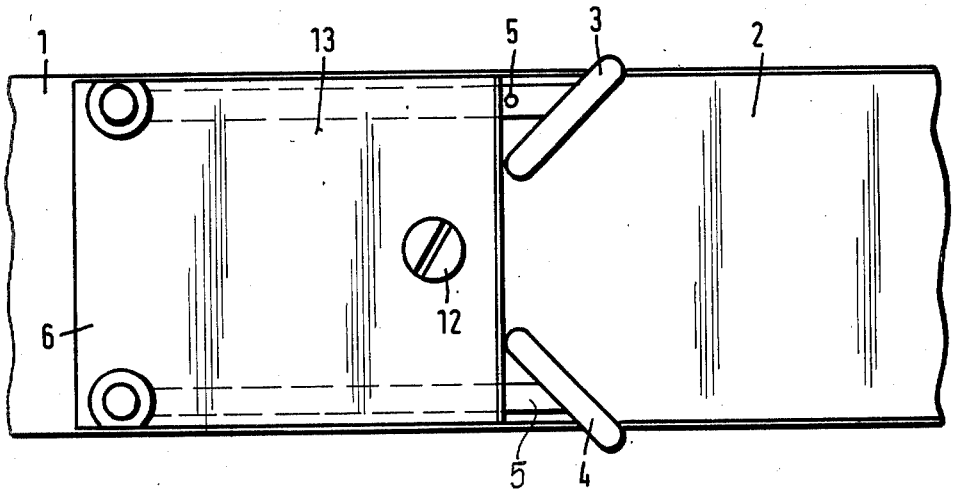
FIG. 1 is a plan view of a front binding.
Figure 2:
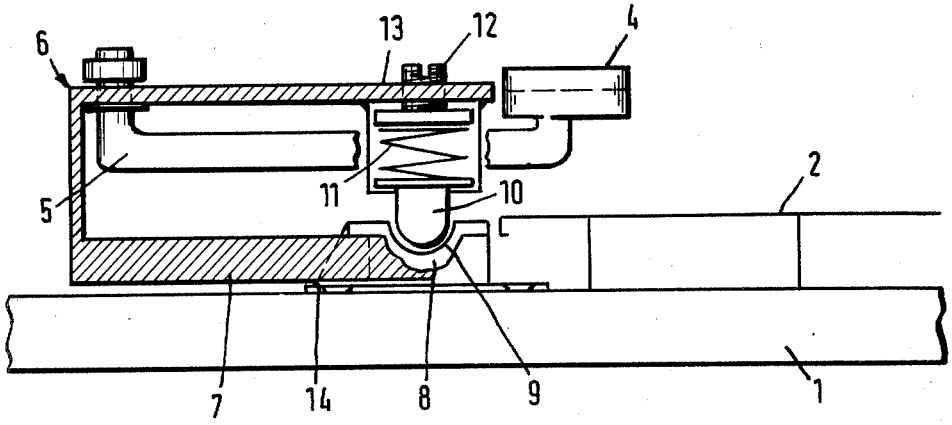
FIG. 2 is a longitudinal section through the front binding of FIG. 1.

Referring now to the drawings, in the case of the embodiment shown in FIGS. 1 and 2, a foot plate 2 for receiving a ski boot (not shown) is secured to a ski 1. In front of the foot plate 2 is situated a front binding which comprises two toe clamps 3 and 4 which are mounted at the ends of respective arms 5, the arms being mounted to pivot outward in a mounting 6. Insert into the lower section 7 of the mounting, which rests on the ski 1, the front binding has a block 8 containing a recess 9. A plunger 10 which is under pressure from a spring 11 and connected to the mounting 6 engages in the recess 9. The force exerted by the spring 11 can be adusted by means of threaded rod 12 which projects through the upper plate 13 of the mounting. The block 8 may have a locating projection 14, which projects into a corresponding recess in the mounting 6, when the binding is in the secured position.

Once the pressure acting on the toe clamps 3 in the longitudinal direction of the ski is sufficiently great for the plunger 10 of the mounting 6 to escape from the block 8, the mounting 6 is able to move forward and thus be separated from the ski 1, so that the ski boot is free to slide forward.

Figure 3:
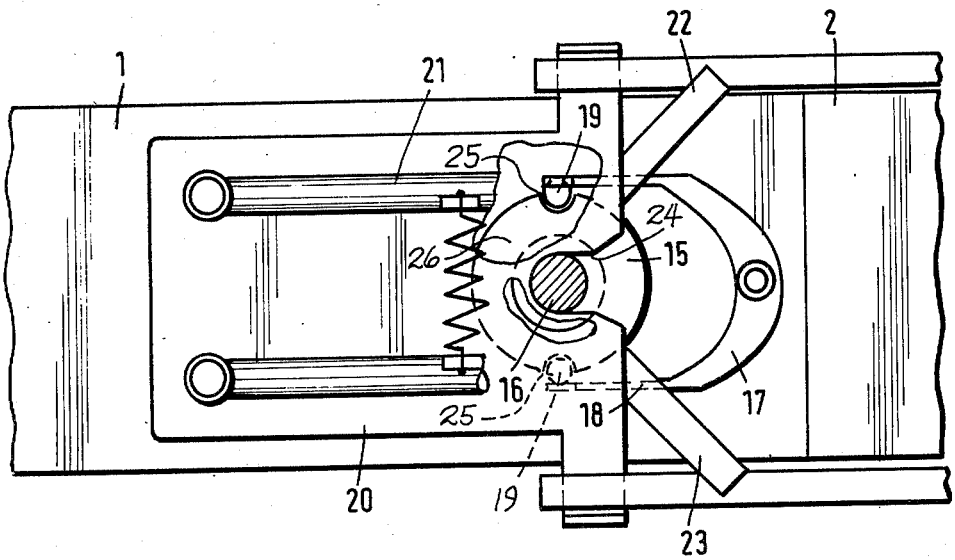
FIG. 3 is a plan view of another embodiment of front binding in the secured position.
Figure 5:
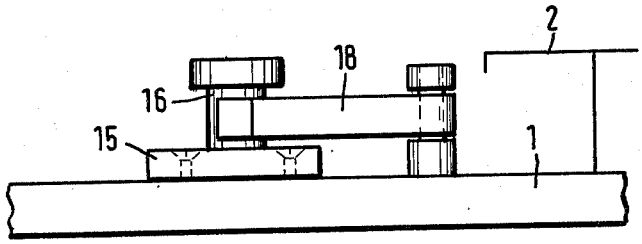
FIG. 5 is a side view of the mounting for the front binding of FIGS. 3 and 4.
Figure 4:
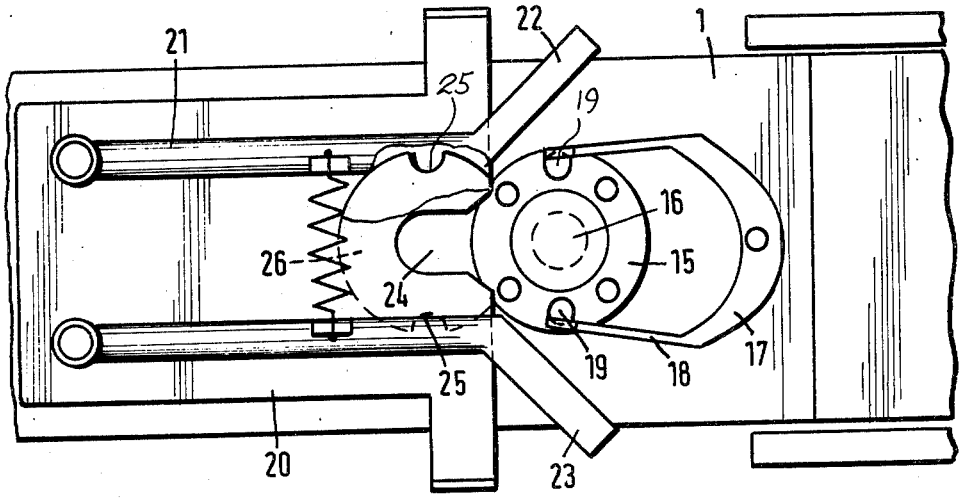
FIG. 4 shows the front binding of FIG. 3 in the released position.

In the embodiment shown in FIGS. 3 to 5, a block 15 is secured to the ski 1 and carries an upwardly projecting locating stem 16. Also, a resilient clip 17 is secured to the ski at a distance from the locating stem 16. The arms 18 of the clip have protruberances 19 at their ends.

A mounting 20, which carries lever arms 21 having toe clamps 22 and 23 at their free ends, contains in its rear edge a cut-out 24 whose inner periphery fits round the locating stem 16 when the front binding is secured. With the front binding in the secured position the protruberances 19 on the clip 17 engage in recesses 25 in a retainer ring 26 which is secured underneath the mounting 20.

In the case of this embodiment too, the front binding mounting 20 is separable from the ski when the pressure in the longitudinal direction of the ski is sufficiently high for the protruberances 19 to leave the recesses 25.

In the case of the embodiment shown in FIGS. 6 and 7, a rebated projection 29, which is gripped by spring-loaded jaws 30 acting like a pair of pincers, is provided on the underside of a mounting 28 carrying a toe clamp 27. The jaws 30 are able to pivot about pins 31 projecting from the ski and are held in the closed position by a compression spring 32. In addition, the mounting 28 and the toe clamps 27 are able to pivot in the jaws, with the projection 29 acting as a pivot shaft. In order to centralise the mounting 28 on the ski 1, there is also a dowel 76 provided which is fixed to the ski.

In the embodiment of FIGS. 8 and 9 also, spring-loaded jaws are carried by the ski as shown at 77 and such jaws engage like a pair of pincers around a rebated projection 29 which is arranged on the underside of the mounting 28 carrying the toe clamps 27. These jaws 77 however are slightly different from those in the previous embodiment since they contain triangular recesses 78 to reduce friction. Also, a rotatable spacer device 79 is provided between the jaws 77 by means of which said jaws can be spread apart to make it easier to insert the mounting 28.

With the embodiment of FIGS. 6 and 7, the mounting 28 is released as soon as the pressure acting in the longitudinal direction of the ski is greater than the retaining force exerted by the jaws 30 and a similar action is present with the jaws 77 of FIGS. 8 and 9.

The mounting 28 is also released however if the toe of the boot, and thus the toe clamps, is forced upward, as it may be a result of a violent impact or if the skier should fall backward. The pressure which acts upward away from the ski, wedges the pincer like jaws 30 apart and the projection 29 escapes from the grip in which it is held.

Figure 10:
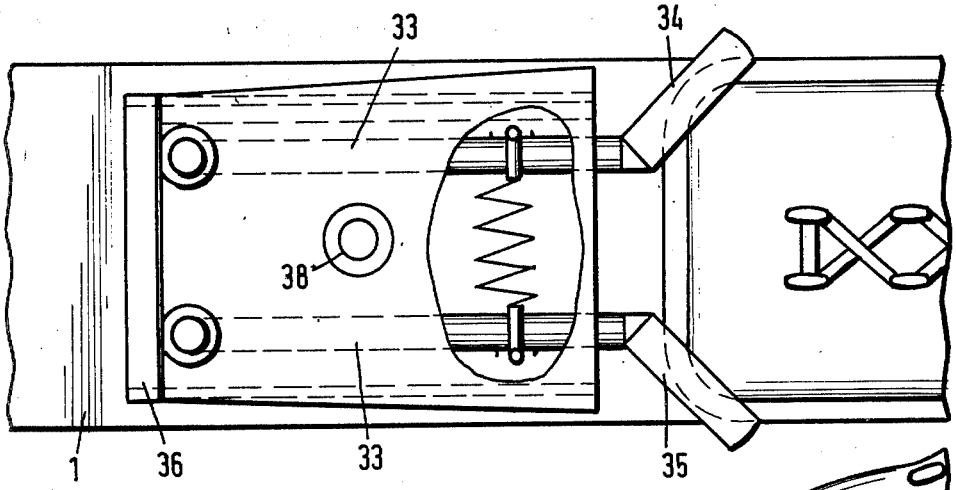
FIG. 10 is a plan view of another embodiment of front binding.
Figure 11:
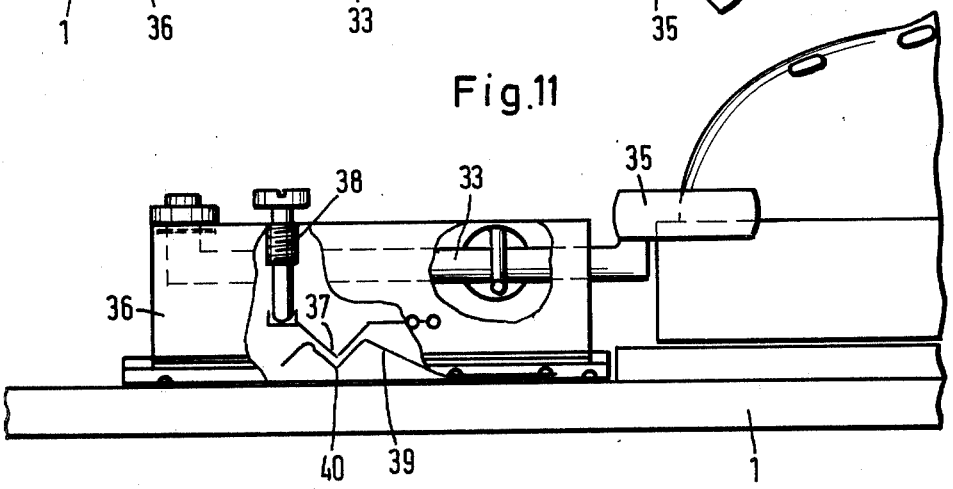
FIG. 11 is a side view of the front binding of FIG. 10.
Figure 12:
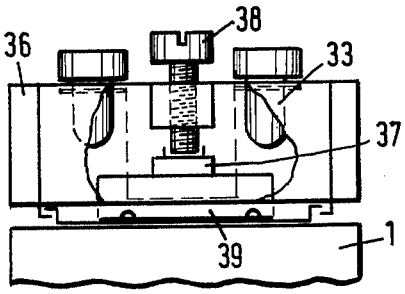
FIG. 12 is a front view of the front binding of FIGS. 10 and 11.

In the case of the embodiment shown in FIGS. 10 to 12, a mounting 36 which carries the arms 33 of the toe clamps 34 and 35 has on the underside a downwardly projecting protruberance 37 the position of which can be adjusted by an by an adjusting screw 38. As is shown in FIG. 11, the protruberance 37 may be formed by a suitably angled arm which is secured to the mounting at one end. Fixed to the ski 1 is a leaf spring 39 the configuration of which is such that it contains a recess 40 in which the protruberance 37 engages when the ski binding is in the secured position.

After it has overcome the force exerted by the leaf spring 39 following a pressure in the longitudinal direction of the ski, the mounting 36 is able to move forward and be separated from the ski 1.

Figure 13:
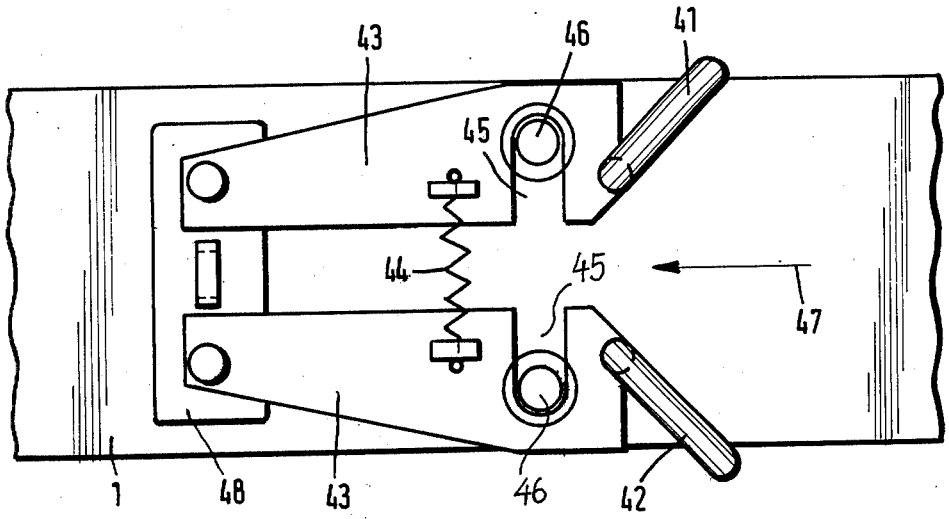
FIG. 13 is a plan view of another embodiment of front binding.
Figure 14:
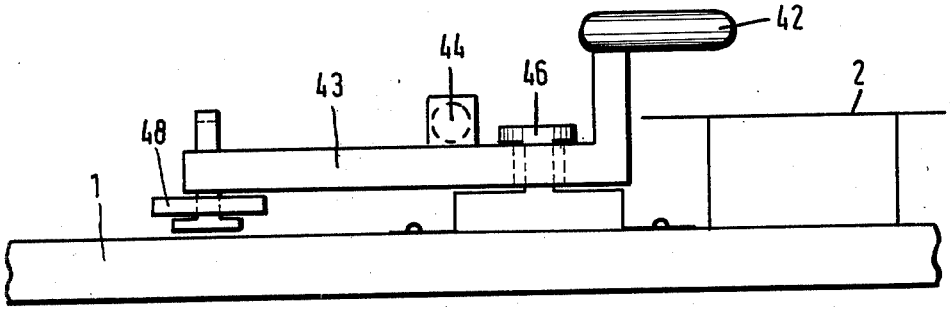
FIG. 14 is a side view of the front binding of FIG. 13.

In the embodiment shown in FIGS. 13 and 14, the toe clamps 41 and 42 are each arranged on an outwardly pivotable carrier 43 and the two carriers 43 are held together by a spring 44. The carriers 43 contain slots 45 extending approximately transversely to the longitudinal direction of the ski and pegs 46 fixed to the ski project through the slots when the ski binding is secured. If pressure exerted by a boot acts in the longitudinal direction of the ski (indicated by arrow 47), the boot has the effect of a wedge and spreads the carriers 43 apart and the carriers 43 are released from the pegs 46, with the result that the mounting 48 carrying the carriers 43 is separated from the ski 1 and the ski boot can escape in the forward direction.

The embodiment shown in FIGS. 15 to 18 is similar to that shown in FIGS. 11 and 12 but in this case the carriers 51 carrying the toe clamps 49, 50 have downwardly projecting pegs 52 which engage in arcuate slots 53 in a plate 54 connected to the ski 1.

Figure 15:
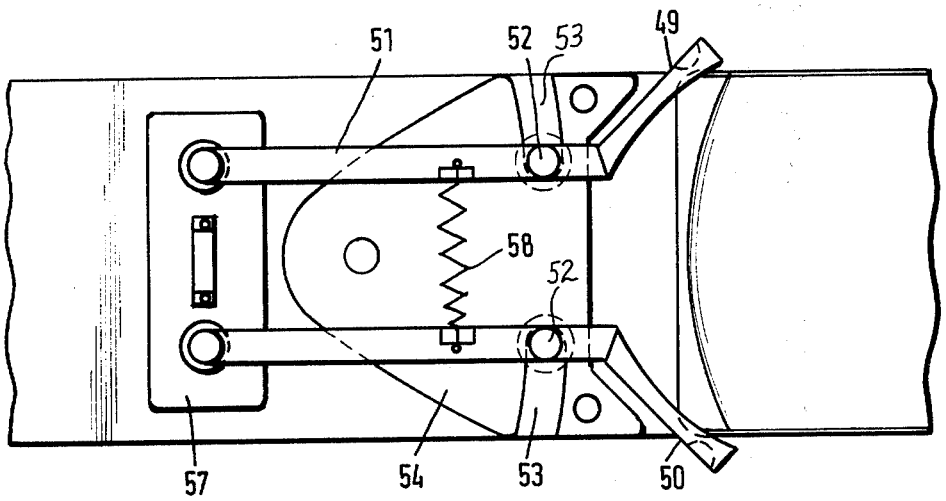
FIG. 15 is a plan view of yet a further embodiment of front binding in the secured position.
Figure 16:
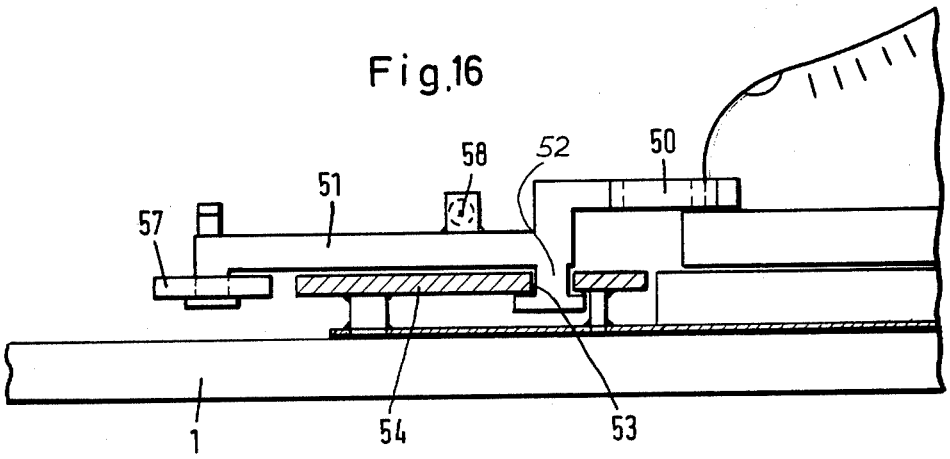
FIG. 16 is a side view of the front binding of FIG. 15.
Figure 17:
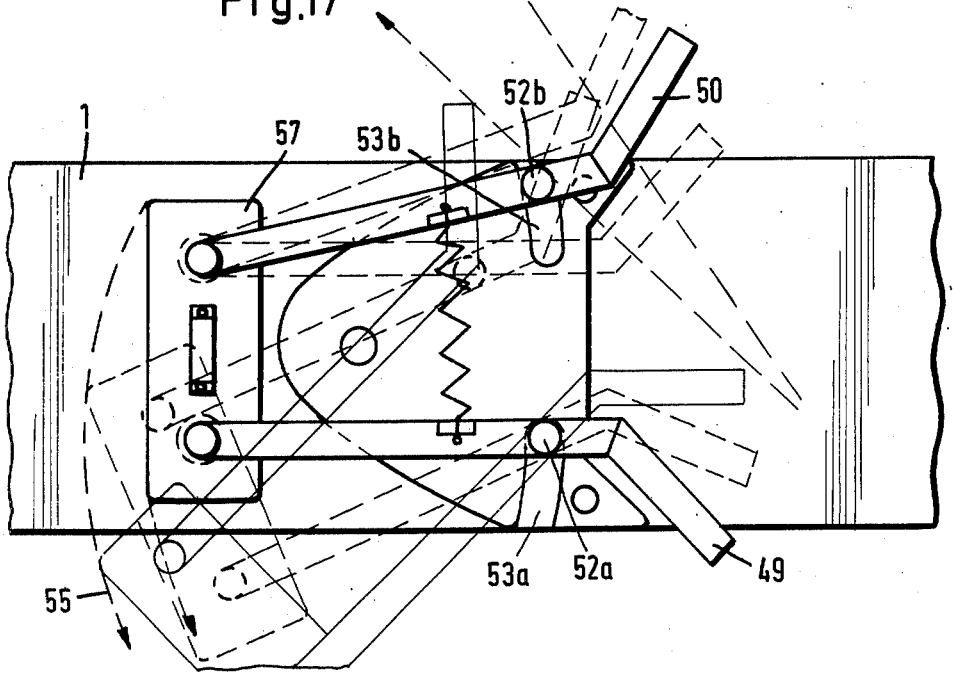
FIG. 17 shows the front binding of FIG. 15 in the position assumed where there is lateral pressure on one of the toe clamps.

FIG. 15 shows the secured position while FIG. 17 shows the position resulting from an oblique pressure being exerted on the sole clamp, as a result of which the front binding is pivoted in the direction of arrow 55 but is not released owing to the fact that peg **52*a* remains engaged in slot 53*a***.

Figure 18:
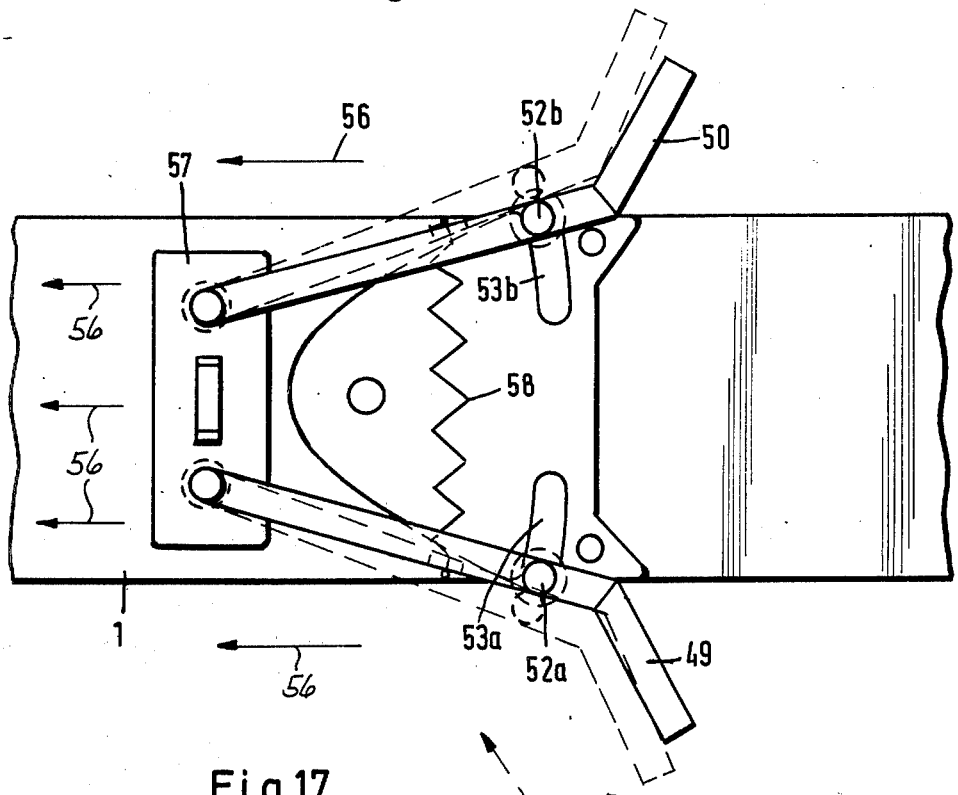
FIG. 18 shows the front binding of FIG. 15 experiencing a pressure in the longitudinal direction of the ski.

In the position shown in FIG. 18 on the other hand a pressure has been exerted in the longitudinal direction of the ski, as indicated by the arrows 56, as a result of which the toe clamps 49 and 50 are forced outward by equal amounts by a wedge effect until the pegs **52*a* and 52*b* clear their associated slots 53*a* and 53*b* and the mounting 57, together with toe clamps 49 and 50, is thus separated from the ski 1. In this embodiment too there is a spring 58** to ensure that the toe clamps are drawn toward one another when the binding is in the secured position.

As can be seen in FIG. 19, a front binding 59, which may be formed as shown in FIGS. 1 to 18, is enclosed by a cushion 60 of foam rubber or the like and is connected to the ski boot 62 (FIG. 19) or the ski 1 (FIG. 20) by a retainer strap 61. In the embodiment of FIG. 20 the retainer strap may be capable of being rolled up on a spring-loaded spool 63.

Whereas the retainer strap ensures that the front binding is not lost when it is released from the ski as a result of a pressure in the longitudinal direction of the ski, a ski-brake such as is shown in FIGS. 21 to 23 and 24 to 26 is used to prevent the ski from running away when the ski boot has slid forward after being released by the front binding.

Figure 21:
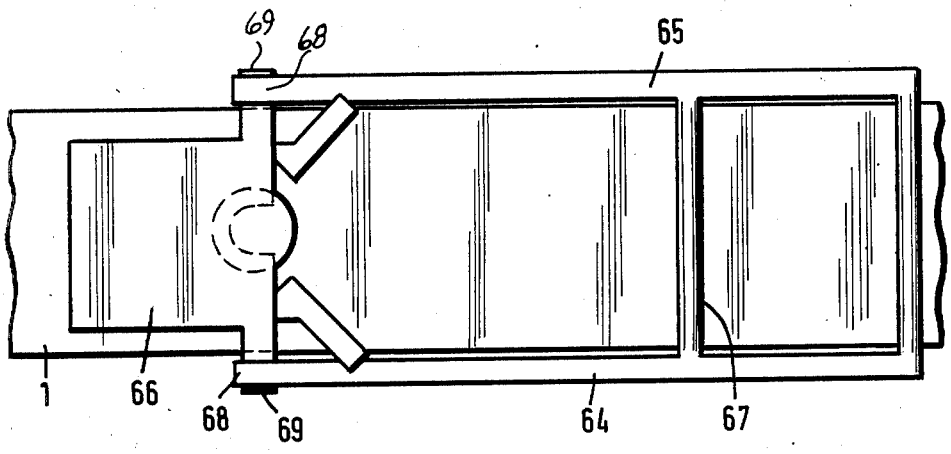
FIG. 21 is a plan-view of a ski binding according to the invention incorporating a ski brake.
Figure 22:
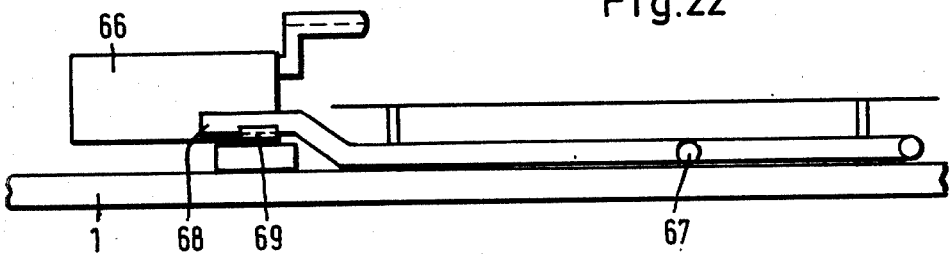
FIG. 22 is a side view of the ski binding of FIG. 21 in the non-braking position.
Figure 23:
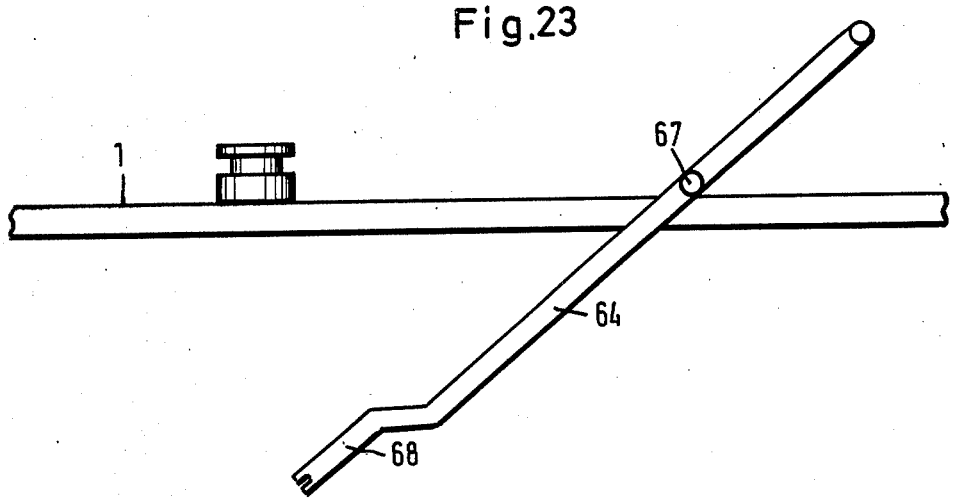
FIG. 23 is a side view of the ski binding of FIG. 21 in the braking position.

As is shown in FIGS. 21 to 23, the arms 64 and 65 of the ski brake are held in place by the front binding 66 when the binding is in the secured position. However, as soon as the front binding frees itself from the ski 1, the arms 64, 65 pivot downward about a pivot shaft 67, dig into the snow, and thus prevent the ski from running away.

Figure 24:
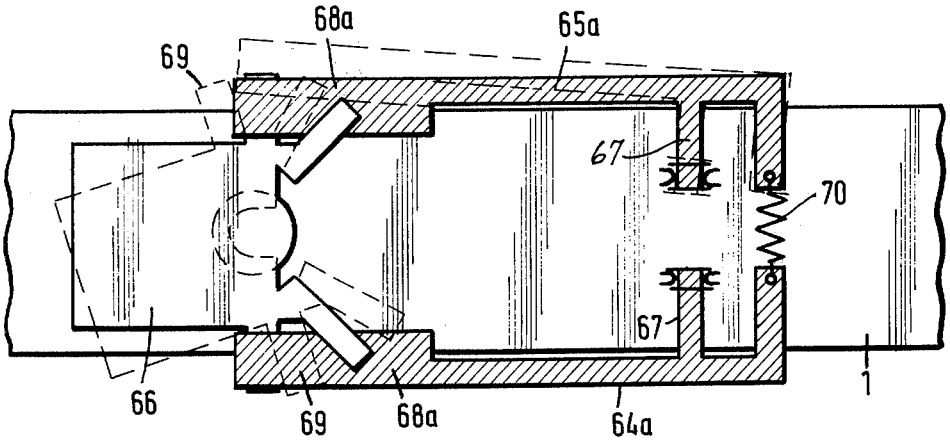
FIG. 24 is a plan view of another embodiment of ski binding according to the invention which incorporates a ski brake.

In the embodiment shown in FIG. 24, the ski brake has two independently acting arms **64*a* and 65*a* which are able to pivot, respectively, about shafts 67. The front ends 68*a* of the arms 64*a* and 65*a*, which in the non-braking position are held raised by lateral projections 69 on the front binding 66, are widened for a more effective braking action. At their rear ends the arms 64*a* and 65*a* are connected by a compression spring 70 which causes the front ends 68*a*** to spread apart when they are released by the projections.

Figure 25:
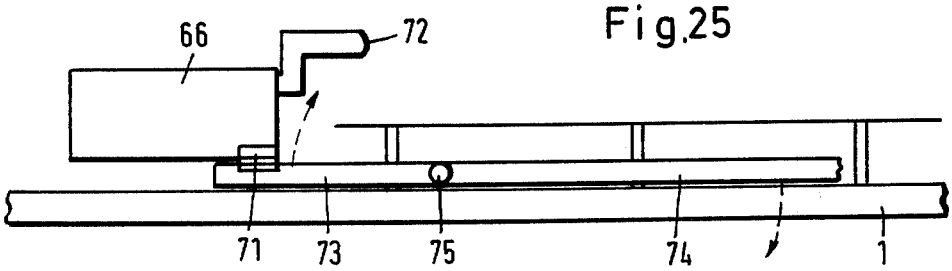
FIG. 25 is a side view of a further embodiment of ski binding according to the invention which incorporates a ski brake, in the non-braking position.
Figure 26:
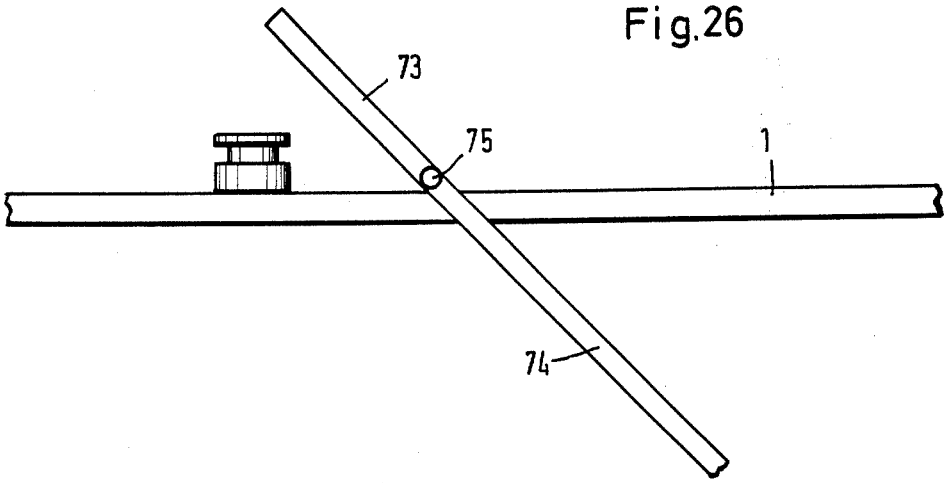
FIG. 26 is a side view of the ski binding of FIG. 25 in the braking position.

Whereas in the case of the embodiment of FIGS. 21 to 23 the front ends 68 of the arms 64, 65 are held raised by lateral projections 69 from the front binding 66 in the non-braking position, in the case of the embodiment in FIGS. 25 and 26 lateral projections 71 from the front binding 66 carrying the toe clamps 72 prevent the front sections 73 of the arms 74 from tilting upward, so that they cannot pivot about the pivot shaft 75 when the front binding 66 is in place on the ski 1.

Figure 27:
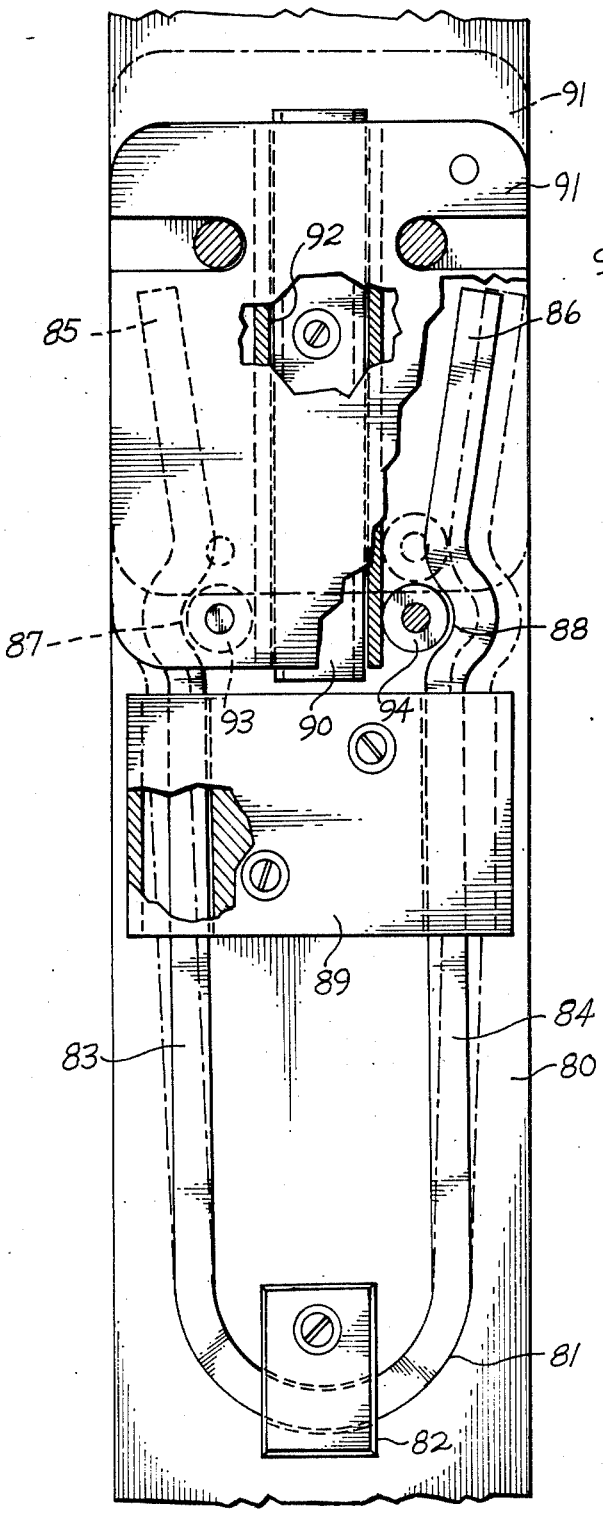
FIG. 27 is a plan view of another embodiment of front binding according to the invention with the toe clamps omitted.
Figure 28:
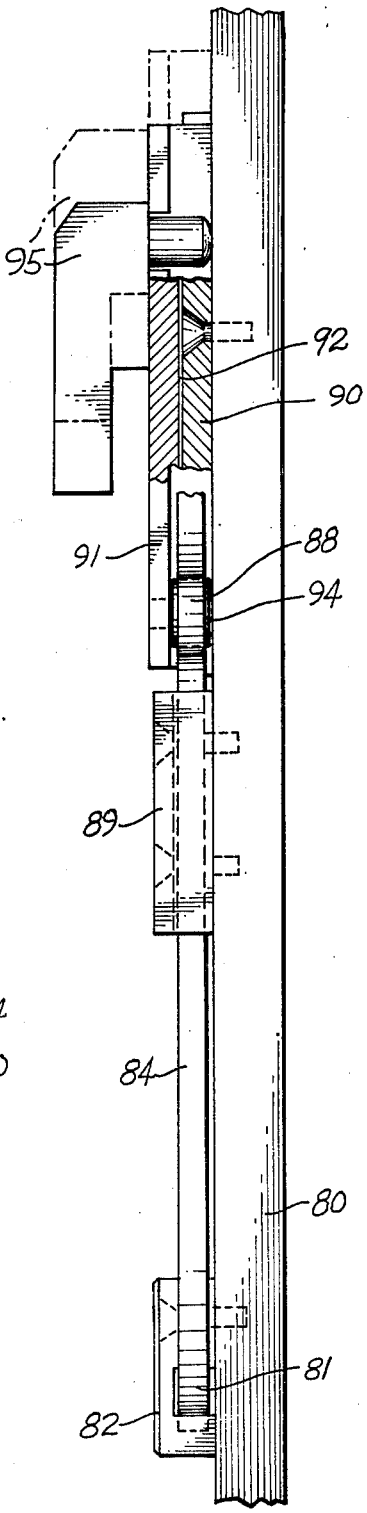
FIG. 28 is a section through the device of FIG. 27.

In FIGS. 27 and 28, the central portion of a U-shaped spring clip 81 is secured to a ski 80 by means of a mounting 82. The free ends 85 and 86 of the arms 83 and 84 of the clip point toward the front end of the ski. The arms 83 and 84 of the clip are resilient and near their free ends have laterally directed indentations 87 and 88. A shield 89 which fits over the arms 83 and 84 prevents the sole of the boot from touching the arms and interfering with their resilient movement. The shield may carry a snow scraper on its upper side.

Between the free ends 85 and 86 of the arms 83 and 84 of the clip, a guide rail 90 or guiding projection is provided on the ski 80. A plate 91 which carries the toe clamps 95 of the front binding can be slid onto this guide rail from the front. On its underside the plate 91 has a groove 92 extending in the longitudinal direction of the ski which is rebated in a dovetail shape and into which the guide rail 90 projects when the plate 91 is slid on. Also arranged on the underside of the plate 91 are two fittings 93 and 94 which are arranged next to one another at a distance and which may take the form of rollers. When the plate 91 is slid fully on, the fittings 93 and 94 come into place in the recesses 87 and 88 in the arms 83 and 84 of the retainer clip 81. In this position the plate 91 is held against displacement in the longitudinal direction of the ski. If however a pressure which exceeds a predetermined threshhold is exerted in the longitudinal direction of the ski on the toe clamps 95 of the front binding, the arms 83 and 84 of the retainer clip 81 open and the fittings 93 and 94 are released, thus allowing the plate 91, together with the toe clamps 95, to move forward until it is clear of the guide 90 and is thus free of the ski 80.

The clip 81 may alternatively consist of a plurality of suitably shaped leaf springs lying one above another which are combined together to form a composite spring. By altering the number of springs the retaining force can be varied.

Figure 29:
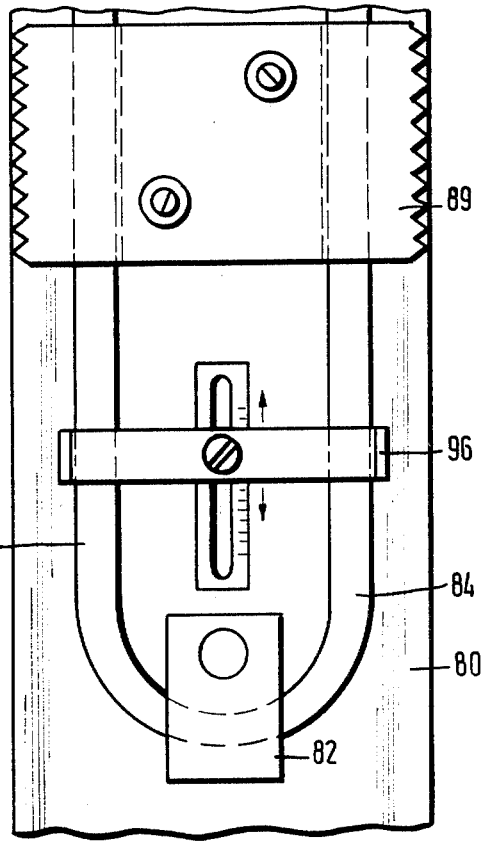
FIG. 29 is a plan view of another embodiment of the retainer clip.
Figure 30:
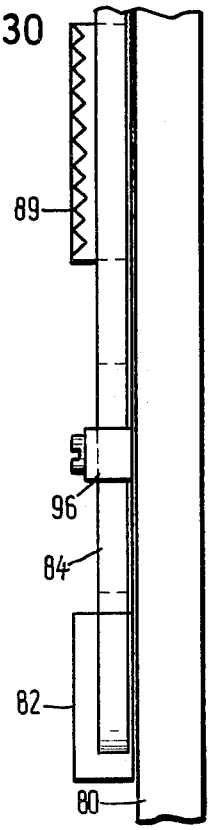
FIG. 30 is a side view of the device of FIG. 29.

In the case of the embodiment shown in FIGS. 29 and 30 an additional clamp 96 which fits over and embraces the arms 83 and 84 of the clip is provided, this clamp being displaceably in the longitudinal direction of the ski and lockable. The resilience of the resilient arms 83 and 84 of the clip can be adjusted by means of this clamp.

Figure 31:
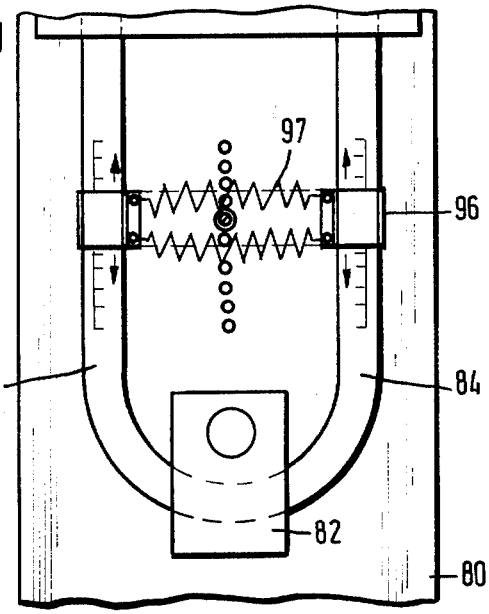
FIG. 31 is a plan view of another embodiment of retainer clip.
Figure 32:
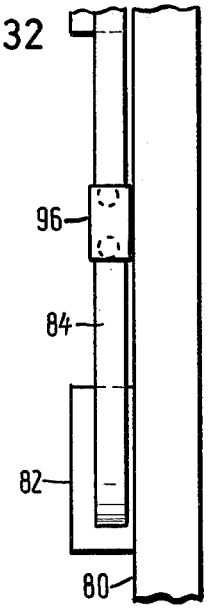
FIG. 32 is a side view of the embodiment of FIG. 31.

In the embodiment shown in FIGS. 31 and 32 the clamp 96 which fits over the resilient arms 83 and 84 of the clip is in the form of a resilient device consisting of tension springs 97. In this case too, the resilience of the arms 83 and 84 can be varied by shifting the tension spring arrangement in the longitudinal direction of the ski.

In the embodiment of FIG. 33, the resilient device 97 is replaced by a pre-tensed part 98 made of resilient material which can similarly be shifted in the longitudinal direction of the ski to enable the resilience of the resilient arms 83 and 84 to be altered.

As can be seen in FIG. 34, a layer 99 of anti-friction material may be arranged between the plate 91 and the ski 80.

So that the device may also be used for commercially available front bindings, mounting holes 100 are provided in the plate 91, as shown in FIG. 35.

Figure 36:
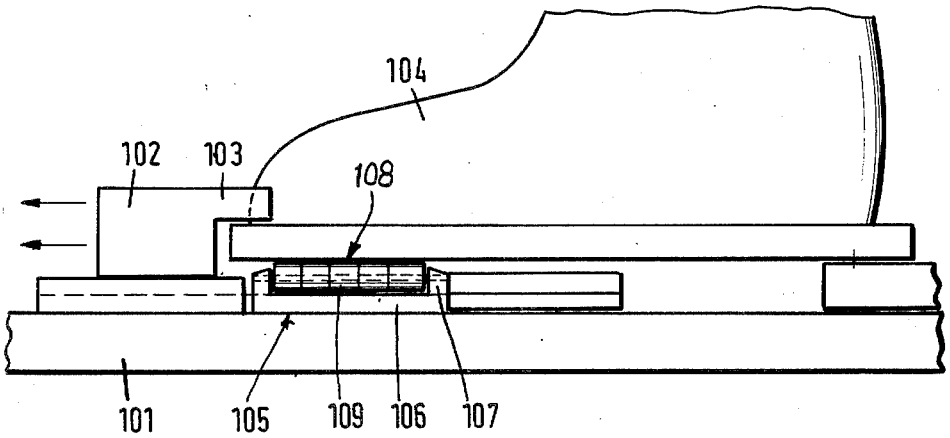
FIG. 36 is a side view of a ski binding having a slide portion of roller form.
Figure 37:
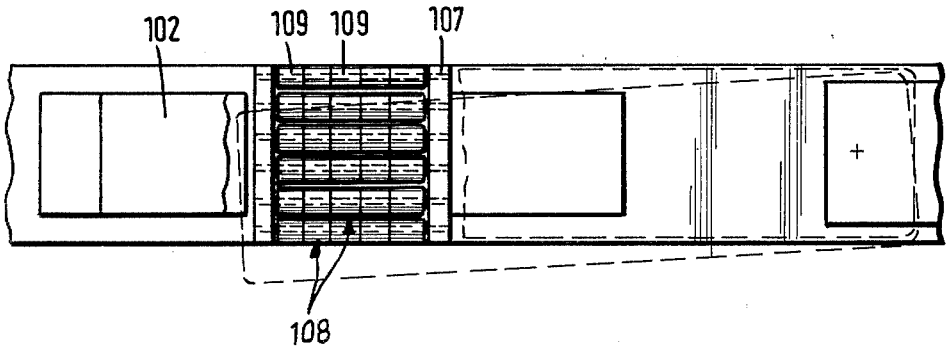
FIG. 37 is a plan view of the arrangement of FIG. 36.
Figure 38:
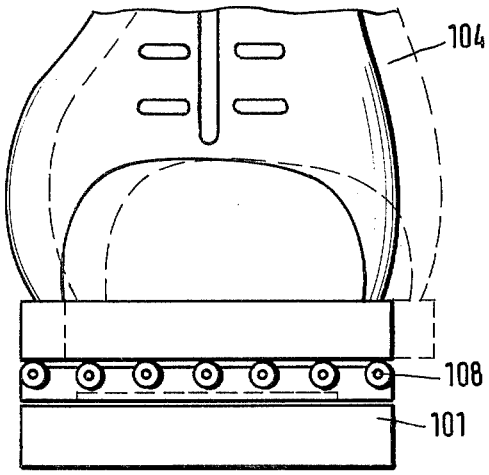
FIG. 38 is a front view of the embodiment of FIG. 36.

In FIGS. 36 to 38 a ski 101 has arranged on it a front binding 102 which has toe clamping jaws 103 which grasp the sole of a ski boot 104 when the binding is secured.

Near the front binding 102, a slide portion 105 is arranged on the ski 101 which consists of a mounting 106 in which are mounted the shafts 107 of rollers 108 which are arranged next to one another.

As can be seen in FIGS. 36 and 37, each roller 108 has sections 109 arranged one behind the other on its allotted shaft 107.

If the sole of the ski boot moves sideways, the rollers 108 turn in the appropriate direction, which means that the frictional resistance between the sole of the ski boot and the ski is very low.

In the case of the embodiment of FIGS. 39 and 40 the center rollers 110 are larger in diameter than the lateral rollers 111. In addition, the center rollers 110 have a constriction 112 in their circumferential surfaces. This constriction provides an escape for snow or sand.

The rollers 110 and 111 are arranged at a distance from one another and are rotatable independently of one another.

To allow the sole of the ski boot to slide in the longitudinal direction of the ski, the rear edge 113 of each of the rollers 108, 110 and 111 is bevelled or rounded as shown in FIG. 41.

It is also possible to provide the portion 114 of the mounting adjacent the rear end-face of the roller with a bevel 115 as shown in FIG. 42.

In the embodiment shown in FIG. 43, the rollers 108, which are arranged at intervals next to one another, are arranged on radii of a segment of a circle so as to provide for the best possible movement when the sole of the ski boot pivots.

As shown in FIG. 44, in the case of a front binding in which the part 102*a* carrying the toe clamping jaws is able to move foward when a pressure acts in the longitudinal direction of the ski, the rollers 108 are connected to the front part 102*a* in such a way that they are released from the ski 101 together with part 102*a*.

In the embodiment shown in FIG. 45, the rollers 110 and 111 are staggered relative to one another to provide the space required for assembly members such as screws 116 or the like.

Figure 46:
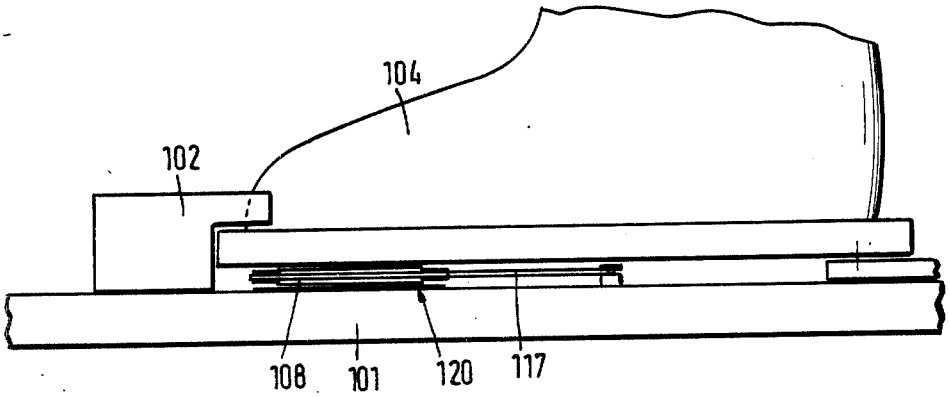
FIG. 46 is a side view of another embodiment of ski binding.
Figure 47:
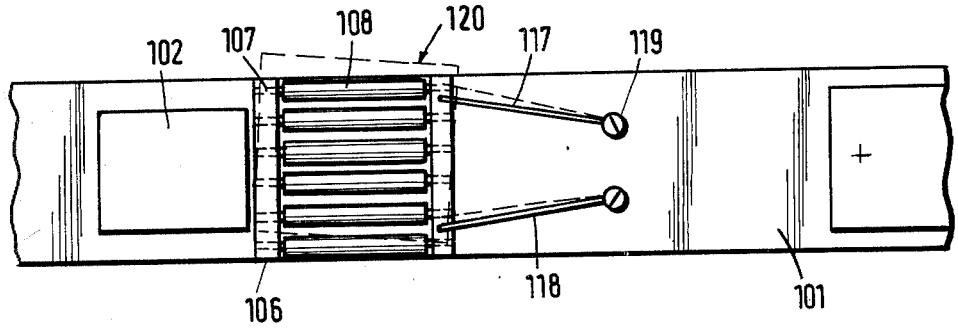
FIG. 47 is a plan view of the arrangement of FIG. 46.
Figure 48:
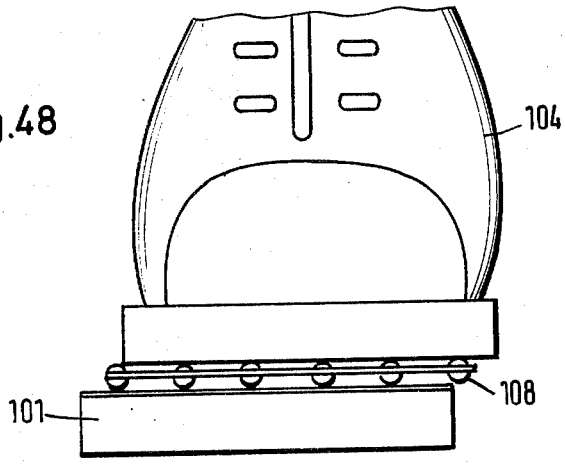
FIG. 48 is a front view of the arrangement of FIG. 46.

In the embodiment of FIGS. 46 to 48, the rollers 108 are connected, in their mounting 106, to form a roller unit which is held by resilient ties 117 and 118. The resilient ties 117 and 118 are connected to the ski 101 at one end by screws 119. With an arrangement of this nature, when the sole of the ski boot executes a pivotal movement, the individual rollers 108 are able to turn on their shafts 107 and the complete roller unit 120 is able to swing to one side or the other as indicated by the broken line in FIG. 47. The resilient ties 117 and 118 ensure that in each case the roller unit 120 will return to its original position when the lateral pressure ceases.

Since in this embodiment the sole of the boot slides on the rollers 108 and the rollers 108 are able to pivot as a unit relative to the ski 101, the pivoting movement of the ski boot is further improved.

Figure 49:
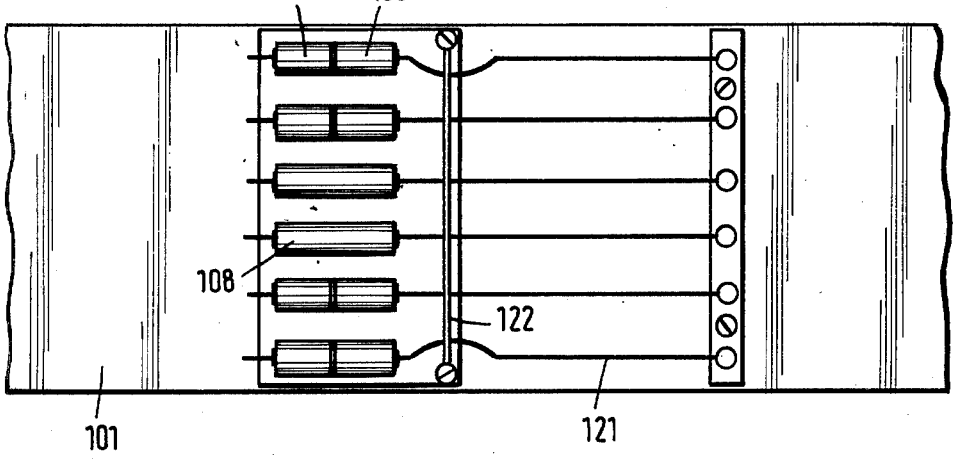
FIG. 49 is a plan view of another embodiment.
Figure 50:
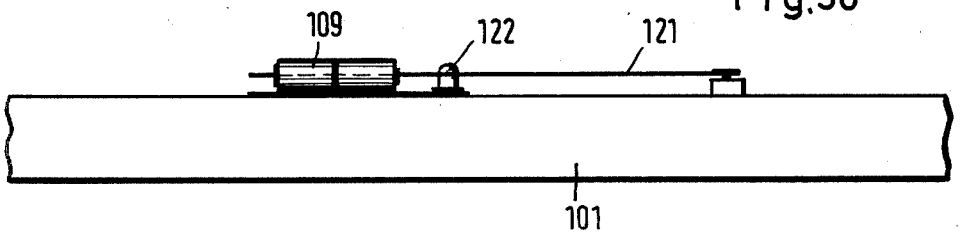
FIG. 50 is a side view of the embodiment of FIG. 49.

In the embodiment shown in FIGS. 49 and 50, each roller, which may be divided up into sections 109, is mounted at the end of a resilient tie 121, as a result of which each roller is able to pivot independently. A retainer strap 122 which fits over all the resilient ties 121 prevents the rollers 108 from lifting clear of the ski 101 and from swinging too far in either direction.

Figure 51:
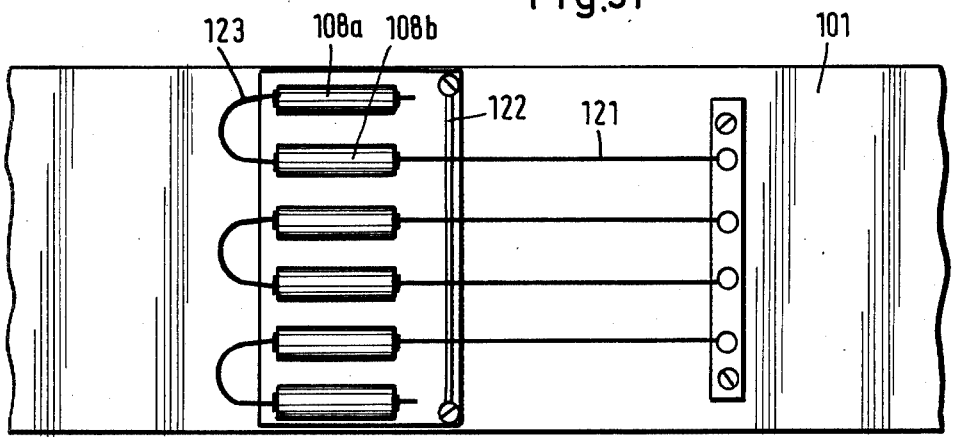
FIG. 51 is a plan view of another embodiment, FIG. 52, on the drawing sheet with FIGS. 44 and 45, is a plan view of a slide portion having spherical rollers, and FIG. 53, on the drawing sheet with FIGS. 44 and 45, is a side view of the slide portion of FIG. 52.

In the embodiment of FIG. 51, pairs of rollers 108*a* and 108*b* are connected together by respective wire clips 123.

In the embodiment shown in FIGS. 52 and 53, the rollers, which were cylindrical in the previous embodiments, are shown as universally rotatable balls 124, which may likewise be arranged at intervals and staggered relative to one another as can be seen in the drawings.

I claim:

1. In a ski binding including a toe clamp for securing a ski boot to a ski, such toe clamp being separable from the ski, the improvement comprising means mounting the toe clamp on the ski for separation of the toe clamp both from the ski and the ski boot automatically in response to a forward force in excess of a predetermined force being exerted on the toe clamp by the ski boot.

2. In the ski binding defined in claim 1, the mounting means mounting the toe clamp for movement longitudinally of the ski in response to a forward force in excess of the predetermined force being exerted on the toe clamp by the ski boot.

3. In the ski binding defined in claim 2, the mounting means including a first member secured to the ski and a second member movable longitudinally of the ski and carrying the toe clamp, said first and second members having mutually interfitting surfaces disengageable by movement of said second member longitudinally of the ski.

4. In the ski binding defined in claim 3, the toe clamp being pivotally mounted on the second member for swinging about an upright axis relative to the ski.

5. In the ski binding defined in claim 3, resilient means for normally maintaining the interfitting surfaces of the first and second members engaged.

6. In the ski binding defined in claim 5, the interfitting surface of the first member being movable relative to the ski, and the resilient means biasing the interfitting surface of the first member toward the interfitting surface of the second member.

7. In the ski binding defined in claim 5, the interfitting surface of the first member being stationary relative to the ski, and the resilient means biasing the interfitting surface of the second member toward the interfitting surface of the first member.

8. In the ski binding defined in claim 3, the first member including an arm having an end portion secured to the ski, the interfitting surface of the first member being carried by said arm spaced longitudinally of the ski from said end portion, the interfitting surface of one of the members being an indentation and the interfitting surface of the other member being a projection received in said indentation.

9. In the ski binding defined in claim 3, the first member being a U-shaped spring clip having a central portion secured to the ski and spaced, generally parallel resilient arms extending from said central portion generally longitudinally of the ski, and the second member including interfitting portions spaced laterally of the ski and engaged, respectively, by said spring clip arms.

10. In the ski binding defined in claim 9, means for adjusting the degree of resilient force exerted by the spring clip arms on the second member interfitting portions.

11. In the ski binding defined in claim 10, the adjusting means including an element extending generally transversely of the ski, engaging the spring clip arms and displaceable longitudinally of the arms.

12. In the ski binding defined in claim 11, the adjusting means including a clamp embracing the spring clip arms.

13. In the ski binding defined in claim 11, the adjusting means including spring means connected between the spring clip arms.

14. In the ski binding defined in claim 3, the first member including a stem projecting from the ski and the second member including a recess receiving said stem.

15. In the ski binding defined in claim 3, one of the members having an open-ended slot extending generally transversely of the ski, the other member having a peg received in said slot, the second member being swingable outward relative to the ski about a generally upright axis for relative movement of said peg out of said slot, and resilient means for biasing the second member to an inward swung position with said peg received in said slot.

16. In the ski binding defined in claim 15, the first member having the peg and the second member having the slot, said first member peg projecting upward from the ski.

17. In the ski binding defined in claim 15, the second member having the peg and the first member having the slot, said second member peg projecting downward toward the ski.

18. In the ski binding defined in claim 17, the slot being arcuate.

19. In the ski binding defined in claim 3, the second member including a rebated projection and the first member including a spring-loaded jaw normally engaged with said projection.

20. In the ski binding defined in claim 3, the first member including a leaf spring having a recess and the second member including a protuberance projecting downward toward the ski and received in said leaf spring recess.

21. In the ski binding defined in claim 3, one of the members have a recess and the other member including a spring-loaded plunger received in said recess.

22. In the suki binding defined in claim 3, the improvement further comprising brake means extending generally longitudinally of the ski and pivotally mounted thereon for swinging about an axis extending generally laterally of the ski, and means for swinging said brake means to project generally outward from the ski automatically upon separation of the toe clamp from the ski.

23. In the ski binding defined in claim 22, the brake means including an end portion normally engaged with the second member.

24. In the ski binding defined in claim 1, the improvement further comprising a strap connecting the toe clamp and the ski.

25. In the ski binding defined in claim 1, the improvement further comprising a strap connecting the ski boot and the toe clamp.

26. In the ski binding defined in claim 1, the improvement further comprising a roller carried by the ski and supporting the ski boot, said roller being rotatable about an axis extending generally longitudinally of the ski.

27. In a ski binding including a toe clamp mounted on a ski for clamping a ski boot to the ski, the improvement comprising means enabling separation of the toe clamp from the ski automatically in response to a forward force in excess of a predetermined force being exerted on the toe clamp by the ski boot for terminating the boot-clamping action of the toe clamp.

28. In a ski binding including a toe clamp for normally securing a ski boot to a ski, such toe clamp being separable from the ski, the improvement comprising means carrying the toe clamp, and means mounting said toe clamp-carrying means on the ski for separation of said toe clamp-carrying means therefrom automatically in response to a forward force in excess of a predetermined force being exerted on the toe clamp by the ski boot, said mounting means including means guiding said tow clamp-carrying means for movement longitudinally of the ski and normally preventing substantial sideways movement of said toe clamp-carrying means transversely of the ski.

29. In a ski binding including a toe clamp for securing a ski boot to a ski, such toe clamp being movable for releasing the ski boot from the ski automatically in response to a force in excess of a predetermined force being exerted on the toe clamp by the ski boot, the improvement comprising means mounting the toe clamp for movement longitudinally of the ski in response to a forward force in excess of the predetermined force being exerted on the toe clamp by the ski boot, said mounting means including a first member secured to the ski and a second member movable longitudinally of the ski and carrying the toe clamp, said first and second members having mutually interfitting surfaces disengageable by movement of said second member longitudinally of the ski, the interfitting surface of said first member being movable relative to the ski, and resilient means for normally maintaining such interfitting surfaces engaged.

30. In a ski binding including a toe clamp for securing a ski boot to a ski, such toe clamp being movable for releasing the ski boot from the ski automatically in response to a force in excess of a predetermined force being exerted on the toe clamp by the ski boot, the improvement comprising means mounting the toe clamp for movement longitudinally of the ski in response to a forward force in excess of the predetermined force being exerted on the toe clamp by the ski boot, said mounting means including an elongated arm member having an end portion secured to the ski and a second member movable longitudinally of the ski and carrying the toe clamp, said members having mutually interfitting surfaces disengageable by movement of said second member longitudinally of the ski, the interfitting surface of one of said members being an indentation and the interfitting surface of the other of said members being a projection received in said indentation.

31. In a ski binding including a toe clamp for securing a ski boot to a ski, such toe clamp being movable for releasing the ski boot from the ski automatically in response to a force in excess of a predetermined force being exerted on the toe clamp by the ski boot, the improvement comprising means mounting the toe clamp for movement longitudinally of the ski in response to a forward force in excess of the predetermined force being exerted on the toe clamp by the ski boot, said mounting means including a U-shaped spring clip member having a central portion secured to the ski and spaced, generally parallel resilient arms extending from said central portion generally longitudinally of the ski, said mounting means further including a second member movable longitudinally of the ski and carrying the toe clamp, said members having mutually interfitting surfaces disengageable by movement of said second member longitudinally of the ski, the interfitting surfaces of said second member including interfitting portions spaced laterally of the ski and normally engaged, respectively, by said spring clip member arms.

32. In the ski binding defined in claim 31, means for adjusting the degree of resilient force exerted by the spring clip member arms on the second member interfitting portions.

33. In the ski binding defined in claim 32, the adjusting means including an element extending generally transversely of the ski, engaging the spring clip member arms and displaceable longitudinally of the arms.

34. In the ski binding defined in claim 33, the adjusting means including a clamp embracing the spring clip member arms.

* * * * *

UNITED STATES PATENT AND TRADEMARK OFFICE

CERTIFICATE OF CORRECTION

PATENT NO. : 4,169,612

DATED : October 2, 1979

INVENTOR(S) : Bernhard Kirsch

It is certified that error appears in the above-identified patent and that said Letters Patent are hereby corrected as shown below:

Title page, [56] References Cited, cancel "Schweiger" and insert --Schweizer--.

Column 10, line 34, cancel "have" and insert --having--; line 36, cancel "suki" and insert --ski--.

Column 11, line 5, cancel "tow" and insert --toe--.

Signed and Sealed this

*Twenty-second* Day of *January 1980*

[SEAL]

*Attest:*

SIDNEY A. DIAMOND

*Attesting Officer*

*Commissioner of Patents and Trademarks*